US005600431A

United States Patent [19]

Takeda et al.

[11] Patent Number: 5,600,431

[45] Date of Patent: Feb. 4, 1997

[54] IMAGE FORMING APPARATUS FOR FORMING COLOR IMAGE WITH DRY DEVELOPER

[75] Inventors: Masami Takeda; Kimio Nakahata, both of Kawasaki; Masuo Yamazaki, Yokohama; Katsuhiko Nishimura, Yokohama; Hiromichi Yamada, Yokohama; Tatsuya Nakamura, Tokyo; Tohru Saitou, Yokohama; Tohru Kosaka, Machida; Takashi Shibuya; Yasuo Yoda, both of Kawasaki; Masahide Hirai, Yokohama, all of Japan

[73] Assignee: Canon Kabushiki Kaisha, Tokyo, Japan

[21] Appl. No.: 348,072

[22] Filed: Nov. 23, 1994

[30] Foreign Application Priority Data

Nov. 26, 1993 [JP] Japan ..... 5-321180

[51] Int. Cl.[6] ..... G03G 15/01

[52] U.S. Cl. ..... 399/226; 399/298

[58] Field of Search ..... 355/326 R, 327

[56] References Cited

U.S. PATENT DOCUMENTS

| | | | |
|---|---|---|---|
| 3,987,756 | 10/1976 | Katayama et al. | 355/327 X |
| 4,620,783 | 11/1986 | Tanaka et al. | 355/326 R |
| 4,622,916 | 11/1986 | Tanaka et al. | 118/688 |
| 4,697,915 | 10/1987 | Hayashi et al. | 355/327 |
| 4,743,938 | 5/1988 | Ohno | 355/327 |
| 4,831,408 | 5/1989 | Yoshikawa et al. | 346/157 |
| 4,860,048 | 8/1989 | Itoh et al. | 355/208 |
| 4,862,219 | 8/1989 | Yoshida et al. | 355/202 |
| 4,941,018 | 7/1990 | Kasamura et al. | 355/326 R X |
| 5,160,969 | 11/1992 | Mizuma et al. | 355/326 R |
| 5,285,246 | 2/1994 | Danzuka et al. | 355/326 R X |

FOREIGN PATENT DOCUMENTS 50-93437 7/1975 Japan .

*Primary Examiner*—Nestor R. Ramirez

*Attorney, Agent, or Firm*—Fitzpatrick, Cella, Harper & Scinto

[57] ABSTRACT

This invention relates to a color image forming apparatus for forming a color image with dry developer, capable of preventing deterioration of image quality, resulting from contamination of optical components by the non-magnetic developer scattered from the developing unit. For this purpose there are provided, along the moving direction of an image bearing member effecting endless movement, charging means, optical means, first developing means utilizing developer containing a magnetic component, second developing means utilizing non-magnetic developer of a color different from that of the developer of the first developing means, and transfer means maintained in contact with or close to the image bearing member for transferring a developed image from the image bearing member to a recording material such as paper. A space containing the second developing means is enclosed by the shape of the first developing means, transfer means and image bearing member.

13 Claims, 11 Drawing Sheets

$$SF1 = \frac{(MXLNG)^2}{AREA} \times \frac{\pi}{4} \times 100$$

[ ESTERWAX GENERAL STRUCTURE EQUATION (1) ]

$$[R1 - COO - (CH2)n]_a C [(CH2)m - OCO - R2]_b$$

a, b : THEY MEAN INTEGERS ; a + b = 4

$R_1$, $R_2$ : THEY MEAN ORGANIC BASES WHOSE NUMBERS OF CARBON ARE INTEGERS FROM 0 TO 40 ; DIFFERENCE OF CARBON NUMBERS BETWEEN $R_1$ AND $R_2$ IS EQUAL TO OR MORE THAN 10 n, m : THEY MEAN INTEGERS FROM 0 TO 15 ; THEY DO NOT BECOME 0 AT SAME TIME

FIG. 8A

[ ESTERWAX GENERAL STRUCTURE EQUATION (2) ]

$$[R1 - COO - (CH2)n]_a C [(CH2)m - OH]_b$$

a, b : THEY MEAN INTEGERS ; a + b = 4

$R_1$ : IT MEANS ORGANIC BASE WHOSE NUMBER OF CARBON IS INTEGER FROM 1 TO 40 n, m : THEY MEAN INTEGERS FROM 0 TO 15 ; THEY DO NOT BECOME 0 AT SAME TIME

FIG. 8B

【ESTERWAX GENERAL STRUCTURE EQUATION (3)】 a, b : THEY MEAN INTEGERS FROM 0 TO 3 ; $a + b \leqq 3$ $R_1$, $R_2$ : THEY MEAN ORGANIC BASES WHOSE NUMBERS OF CARBON ARE INTEGERS FROM 0 TO 40; DIFFERENCE OF CARBON NUMBERS BETWEEN $R_1$ AND $R_2$ IS EQUAL TO OR MORE THAN 10

$R_3$ : IT MEANS ORGANIC BASE WHOSE NUMBER OF CARBON IS EQUAL TO OR MORE THAN 1 n, m : THEY MEAN INTEGERS FROM 0 TO 15 ; THEY DO NOT BECOME 0 AT SAME TIME

IMAGE FORMING APPARATUS FOR FORMING COLOR IMAGE WITH DRY DEVELOPER

BACKGROUND OF THE INVENTION

1. Field of the Invention

The present invention relates to an image forming apparatus such as a color printer, a color copying machine or a color facsimile apparatus employing an electrophotographic process.

2. Related Background Art

The conventional color image forming apparatus (for forming an image with two or more colors) employing an electrophotographic recording method generally employs non-magnetic toner as the developer for all the colors (yellow, magenta, cyan and black). Such non-magnetic toners are further classified into two-component non-magnetic toner and one-component non-magnetic toner. The former, being collectible by magnetic force, allows one to prevent contamination of the interior of the apparatus by the scattered toner. On the other hand, the apparatus tends to become heavy because of the use of magnetic carrier or a developing magnet, so that such toner is unsuitable for a compact desk-top printer or the like employing a cartridge structure in the developing unit and associated mechanisms for easy maintenance. This drawback can be resolved by the apparatus employing the latter one-component non-magnetic toner, as exemplified in FIG. 5.

FIG. 5 is a longitudinal cross-sectional view of a color printer of multiple transfer type, employing the one-component non-magnetic toner. At the approximate center of a main body M, there are provided a photosensitive drum (photosensitive member) 1 serving as an image bearing member, a charging roller 2 and a cleaning unit 3. To the right of said photosensitive drum 1 there is provided a developing unit (developing means) 4, which is provided with four non-magnetic developing units 4*a*, 4*b*, 4*c* and 4*d* respectively containing one-component non-magnetic toners of yellow (Y), magenta (M), cyan (C) and black (Bk) colors, and a support member (rotary member) 9 supporting and rotating said developing units (hereinafter often referred to as rotary developing unit).

The developing units 4*a*–4*d* are adapted to rotate, about a rotary axis 9*a* of the support member 9, in a direction R9 along circular rails M1 provided on both ends of the main body M, and are so constructed as to maintain the horizontal position during rotation, whereby developing apertures 5*a*, 5*b*, 5*c* and 5*d* remain horizontal. Said developing units 4*a*–4*d* are provided, as shown in FIG. 6, with coating rollers 6*a*, 6*b*, 6*c* and 6*d*, and toner limiting members 7*a*, 7*b*, 7*c* and 7*d*, and, with the rotation of developing rollers 8*a*, 8*b*, 8*c* and 8*d* in a direction indicated by arrows, toner is coated by the coating rollers 6*a*–6*d* onto the developing rollers 8*a*–8*d* and necessary triboelectric charges are given by the toner limiting members 7*a*–7*d*. Said toner limiting members 7*a*–7*d* can be composed for example of nylon (in the case of charging the toner negatively), or of silicone rubber (in the case of charging the toner positively). More specifically said toner limiting members are preferably composed of a material chargeable to a polarity opposite to the desired polarity of the toner. The peripheral speed of the developing rollers 8*a*–8*d* is preferably within a range from 1.0 to 2.0 times of that of the photosensitive drum 1. The developing units 4*a*–4*d* supported by the support member 9 are so moved that the developing apertures 5*a*–5*d* are constantly opposed to the photosensitive drum 1. Such moving method is detailedly disclosed for example in Japanese Laid-Open Patent Applications 50-93437, and U.S. Pat. Nos. 4,743,938, 4,697,915, 4,620,783, and 4,622,916.

To the left of the photosensitive drum 1 in FIG. 5, there is provided a transfer drum 10 for supporting a recording material (not shown) and serving as transfer means for transferring the toner image, formed on the photosensitive drum 1, onto said recording material. In the upper part of the main body M, there is provided an optical unit (latent image forming means) 16 composed for example of a laser diode 11, a polygonal mirror 13 rotated by a high-speed motor 12, a lens 14 and a mirror 15.

The above-mentioned photosensitive drum 1 is composed of an aluminum cylinder of a diameter of 40 mm, with a photoconductor consisting of an organic photoconductor (OPC) coated on the external periphery, but said OPC may be replaced for example by a-Si, CdS or Se.

At the image forming operation, the photosensitive drum 1 is rotated in a direction R1 by drive means (not shown) with a peripheral speed of 100 mm/sec., whereby the drum surface effects endless movement. The thus-rotated photosensitive drum 1 is charged by the charging roller 2, receiving a DC voltage of −700 V overlapped with a peak-to-peak AC voltage of 1500 V with a frequency of 700 Hz, whereby the surface of the photosensitive drum 1 is uniformly charged to ca. −700 V.

The laser diode 11 of the optical unit 16 emits a laser beam in response to the entry of signals according to the yellow image pattern, and said laser beam irradiates the photosensitive drum 1 through an optical path L formed by the polygon mirror 13, lens 14, mirror 15 etc., whereby the potential of the photosensitive drum 1 drops to ca. −100 V in the irradiated portion and a latent image is thus formed.

The photosensitive drum 1 further rotates in the direction R1, whereby the latent image on the surface is subjected to the deposition of yellow toner by the yellow developing unit 4*a* of the developing device 4 and is rendered visible as a toner image. Prior to the developing operation, the developing unit 4*a* is brought to a developing position opposed to the image bearing member, by the rotation of the support member 9 in a direction R9. Subsequently the toner image on the photosensitive drum 1 is transferred onto the recording material supported on the transfer drum 10.

Said recording material is supplied from a cassette 17 by means of a pick-up roller 18 in synchronization with the toner image on the photosensitive drum 1, and is adhered to the transfer drum 10. Said transfer drum 10 is composed of a metal cylinder 19 of a diameter of 156 mm, an elastic layer 20 of a thickness of 2 mm and an upper PVDF layer 21 of a thickness of 100 μm formed in succession thereon, and is rotated in a direction R10, with a peripheral speed substantially the same as that of the photosensitive drum 1. When the recording material is supplied, as explained above, onto said transfer drum 10, the front end of the recording material is supported by a gripper 22. Between the transfer drum 10 and the photosensitive drum 1 a transfer voltage is applied by a power source (not source), whereby the yellow toner image on the photosensitive drum 1 is transferred onto the recording material, and the entire recording material is adhered along the surface of the transfer drum 10 by the charge injection into the recording material. If necessary, the recording material may be adhered in advance to the surface of the transfer drum 10 by means of a roller 23.

The above-explained image forming process from the charging to the image transfer is repeated for the remaining three colors magenta, cyan and black, to obtain a four-color image on the recording material. The recording material after the toner image transfer is separated from the surface of the transfer drum 10 by a separating charger 26 and a separating finger 24, then is subjected to fixation of the toner images by fusion in a known fixing unit 25 utilizing heat and pressure, and is discharged, as the final product, from the main body M.

On the other hand, the photosensitive drum 1 is subjected to cleaning of the remaining toner on the surface by a cleaning unit 3 utilizing a fur brush or a blade in the already known manner, and is used again in a next image forming process starting from the charging step. Also the unnecessary toner remaining on the transfer drum 10 is removed by a transfer cleaning unit 7 equipped for example with a fur brush or a web, and, if charge remains on the transfer drum 10 after the separation of the recording material, such charge is eliminated by a charge eliminating roller 28.

In the image forming apparatus explained above, all the toners of yellow, magenta, cyan and black colors employed for the development of latent images are all non-magnetic toners. In contrast to the magnetic toner which is controlled in movement by a magnetic field generated for example by a magnetic developing member incorporating a developing magnet, such non-magnetic toner tends to scatter easily, thus causing contamination of the interior of the main body M. For preventing such contamination, there have been employed various means such as determination of the position of a cooling fan for the electric systems in consideration of the air flow within the main body M, or an exclusive fan for collecting the scattered toner, or a complex scattering preventive mechanism such as shutters for closing the developing apertures 5*a*–5*d* at the switching of the developing units 4*a*–4*d*.

However, if such toner scattering cannot be prevented completely, the contamination of the interior of the main body M is unavoidable in prolonged use of the image forming apparatus, and, if in particular the optical unit 16 constituting the latent image forming means is smeared with the toner, there may result partial interruption of the optical path L or a deficiency in the amount of the laser beam in the exposure (formation of latent image), leading directly to an image defect such as a deficient density in the image development. Such toner scattering hinders the increase in image forming speed of the apparatus since it becomes severer with such speed increase.

SUMMARY OF THE INVENTION

An object of the present invention is to provide a color image forming apparatus capable of preventing the contamination of the optical system by avoiding the scattering of toner.

Another object of the present invention is to provide an image forming apparatus capable of protecting the optical system from the scattering of toner, thereby preventing deterioration of the image quality.

Still another object of the present invention is to provide an image forming apparatus capable of protecting the latent image forming means from the scattering of toner, thereby preventing deterioration of the image quality.

The foregoing objects can be attained, according to the present invention, by an image forming apparatus for forming a color image with dry developer, comprising, in the direction of movement of an image bearing member effecting endless movement, charging means, optical means, first developing means utilizing developer containing a magnetic component, second developing means utilizing non-magnetic developer of a color different from that of the first developing means, and transfer means maintained in contact with or close to the image bearing member for transferring an image of developer, formed on the image bearing member, onto a transfer material, wherein a space containing the second developing means is enclosed by the shape of said first developing means, transfer means and image bearing member.

In the above-mentioned configuration, as the latent image forming means, the magnetic developing unit and the non-magnetic developing unit are arranged in this order from the upstream side in the moving direction of the image bearing member, the magnetic toner of the magnetic developing unit, being attracted by a magnetic developing member therein, is prevented from scattering and does not, therefore, contaminate the latent image forming means. The non-magnetic toner of the non-magnetic developing unit scatters easily, but such scattered toner, even if migrating toward the latent image forming means, does not proceed to the latent image forming means beyond the magnetic developing unit and does not, therefore, cause contamination thereof, since the space around the image bearing member is separated to the side of the non-magnetic developing unit and the side of the latent image forming means, by the magnetic developing unit positioned therebetween.

DETAILED DESCRIPTION OF THE PREFERRED EMBODIMENTS

Figure 5:
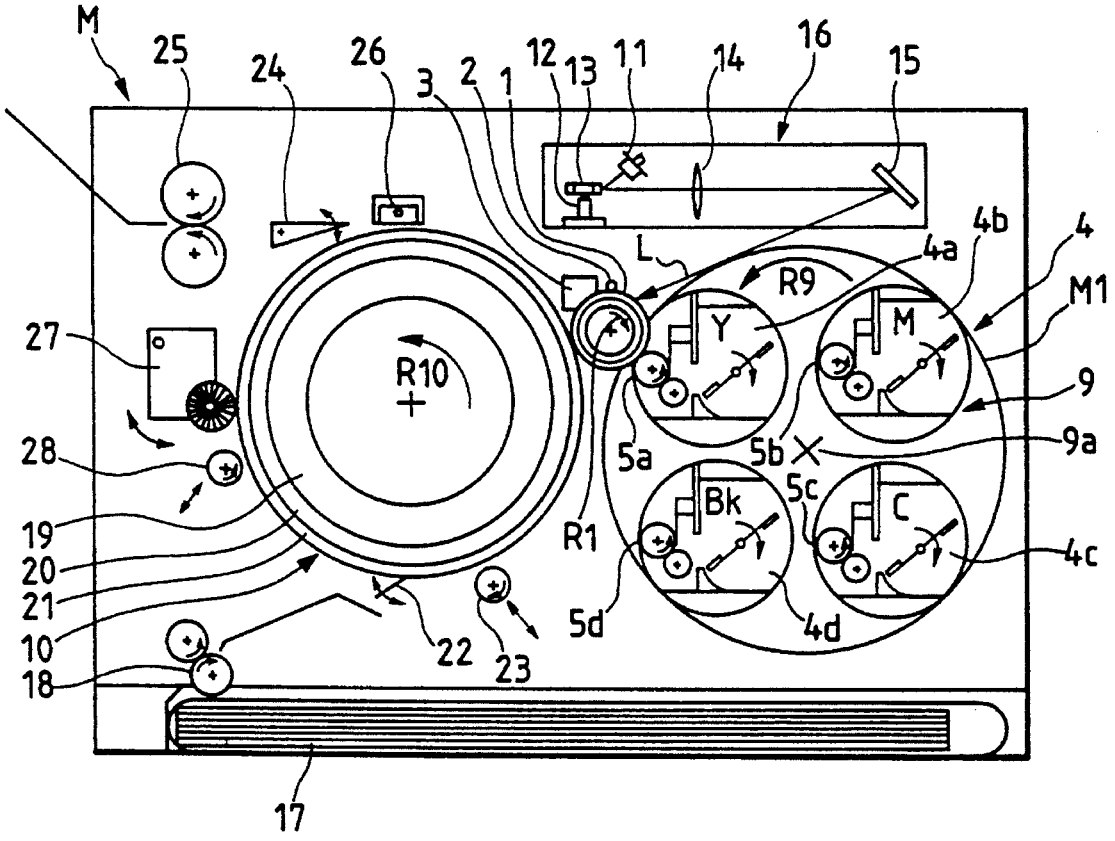
FIG. 5 PRIOR ART
FIG. 5 is a longitudinal cross-sectional view of a conventional image forming apparatus.
Figure 6:
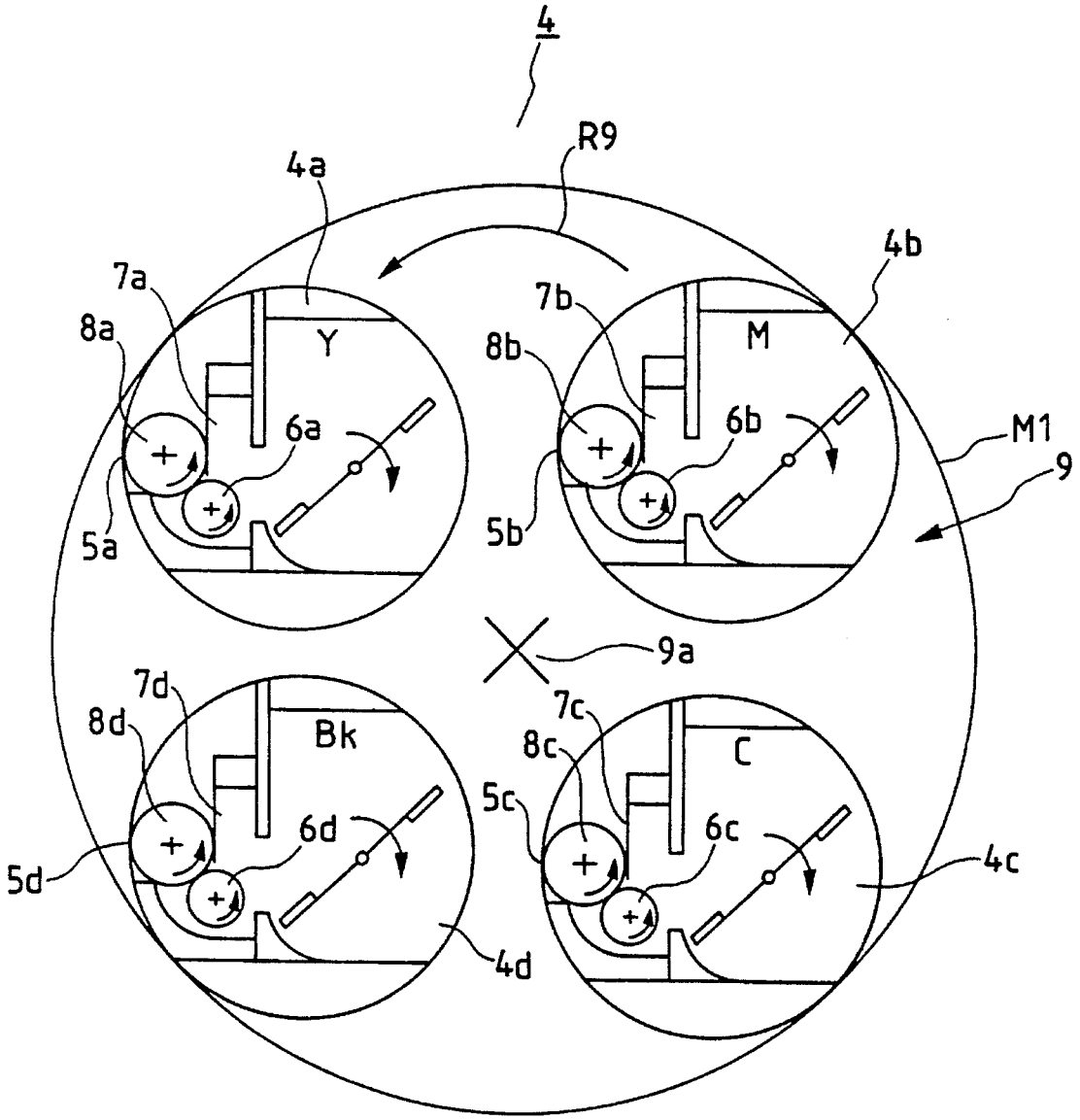
FIG. 6 PRIOR ART
FIG. 6 is a magnified longitudinal cross-sectional view of a developing device employed in the conventional image forming apparatus.

Now the present invention will be clarified in detail by reference to the preferred embodiments thereof. In the drawings referred to in the following description, components which are the same in structure or function as those in the conventional image forming apparatus explained in FIGS. 5 and 6 are represented by the same numbers or symbols, and will not be explained further.

[EMBODIMENT 1]

Figure 1:
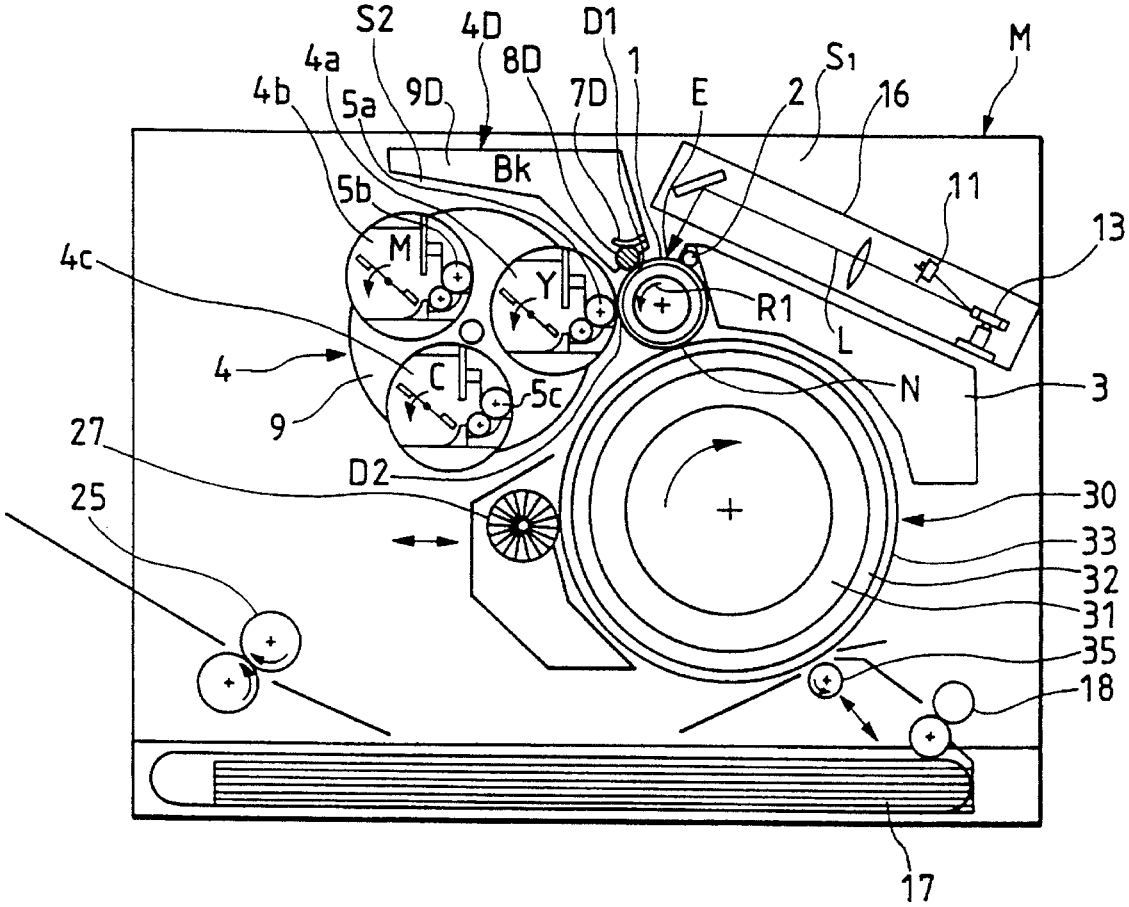
FIG. 1 is a longitudinal cross-sectional view of an image forming apparatus of a first embodiment.

FIG. 1 schematically shows an image forming apparatus constituting an embodiment 1 of the present invention, wherein a black developing unit is composed of a magnetic developing unit employing magnetic toner and is positioned separately from other developing units, thereby separating the space around the photosensitive drum into the side of the latent image forming means and the side of the non-magnetic developing units.

Referring to FIG. 1, above the main body M or above the photosensitive drum 1 constituting the image bearing member, there is provided a magnetic developing unit 4D, which is provided therein with a developing roller (magnetic developing member) 8D containing therein a developing magnet (not shown), a toner limiting member 7D for limiting the amount of toner coated on said developing roller 8D, and a developing container 9D for containing one-component magnetic toner of black color to be supplied to the developing roller 8D.

The developing roller 8D is provided at a first developing position D1, opposed with a small gap to the surface of the photosensitive drum 1. Said gap is selected at such a magnitude that enables effective jumping development on the latent image formed on the photosensitive drum 1 and that can prevent intrusion of the non-magnetic toner of a color developing unit 4*a* etc. to be explained later toward the optical unit 16 through said gap. Also the above-mentioned developing container 9D is extended upwards, with the upper end thereof positioned close to the upper end face of the main body M. The space above the photosensitive drum 1 is thus substantially divided, by means of said developing container 9D and the developing roller 8D, into a space S1 of the side of the optical unit 16, positioned at the upstream side in the rotating direction of the photosensitive drum 1 (i.e. moving direction of the surface of the photosensitive drum 1 effecting endless movement), and a space S2 of the side of the non-magnetic developing device 4 at the downstream side.

The optical unit 16 at the upstream side irradiates the photosensitive drum 1 with the laser beam emitted from the laser diode 11 and guided through the polygonal mirror 13 etc. in the optical path L, thereby forming a latent image on the surface of the photosensitive drum 1 at a latent image forming position E. The non-magnetic developing device 4 (hereinafter called "rotary developing device") at the downstream side is provided with non-magnetic developing units 4*a*, 4*b* and 4*c* of yellow, magenta and cyan colors, and a support member 9 for movably supporting said developing units and bringing a developing unit, to be used next in development, to a second developing position D2 opposed to the photosensitive drum 1.

The latent image forming position E of the above-mentioned optical unit 16, the first developing position D1 of the magnetic developing unit 4D and the second developing position D2 of the rotary developing device 4 are vertically arranged in this order from above, whereby the non-magnetic toners of the non-magnetic developing units 4*a*–4*c* constituting the rotary developing device 4 are prevented from intrusion into the space S1 of the side of the optical unit 16.

In the present embodiment, the photosensitive drum 1 is contacted, from thereunder, by an intermediate transfer member 30 constituting transfer means and composed of a metal cylinder 31, an elastic rubber member (elastic member) 32 of a medium conductivity, and a surfacial coated layer 33 of a similarly medium conductivity.

In the present embodiment, the use of such intermediate transfer member 30 enables image formation at a higher speed than in the image forming apparatus of multiple transfer method as shown in FIG. 5. The intermediate transfer member 30 also serves to substantially divide the space below the photosensitive drum 1 into two areas, in a similar manner to the division of the space above said photosensitive drum 1 by the magnetic developing unit 4*d* into the space S1 at the side of the optical unit and the space S1 at the side of the rotary developing device 4, thereby effectively preventing the intrusion of the non-magnetic toners of the non-magnetic developing unit 4*a*–4*c* into the space S1 through the space below the photosensitive drum 1.

In the image forming apparatus of the above-explained configuration, the image forming process is conducted in the following manner. At first the surface of the photosensitive drum 1 is uniformly charged by the charging roller 2, and a latent image of a first color is formed on said surface, at the latent image forming position E, by the laser beam emitted from the optical unit 16.

The sequence of colors in the developing process is dependent on the quality setting of the final image, but there is selected a sequence of yellow, magenta, cyan and black. At first yellow color development is conducted by rotating the rotary developing device 4 so as to bring the yellow non-magnetic developing unit 4*a* to the second developing position D2 opposed to the photosensitive drum 1. The toner image formed in this development on the photosensitive drum 1 is brought to a nip portion N with the intermediate transfer member 30 and is transferred thereto, under the application of a transfer bias voltage.

The above-explained image forming process from the charging to the image transfer is repeated also for the remaining two color toners. The last development with the black toner is conducted by the application of a developing bias voltage to the magnetic developing unit 4D, while the rotary developing device 4 is maintained free of contact with the photosensitive drum 1.

After the successive transfers of toners of four colors onto the intermediate transfer member 30, a recording material, fed by the pick-up roller 18 from the cassette 17, is transported to a secondary transfer roller 35 which is subjected to the application of a transfer bias voltage capable of re-transferring the toner on the intermediate transfer member 30, whereby the toners of four colors are collectively transferred onto the recording material. The recording material after the toner image transfer is subjected, to the fixation of the toner images of four colors by fusion in the fixing unit 25.

In the above-explained image forming process, the non-magnetic toner tends to scatter from the surfaces of the developing rollers 8*a*, 8*b* and 8*c* at the development with such non-magnetic toner or at the rotary motion of the non-magnetic developing units 4*a*–4*c*, and such toner scattering becomes severer as the process speed becomes higher. Conventionally, for protecting the optical unit 16 from contamination with toner, there have been necessitated various measures such as positioning of the optical unit 16 distant from the developing units 4*a*–4*c* or provision of highly precise shutters on the developing apertures 5*a*, 5*b* and 5*c* of said developing units 4*a*, 4*b* and 4*c*, whereby the configuration of the entire apparatus becomes inevitably complex. It has therefore been difficult to achieve simplification and compactization of the entire structure and a higher speed in the image formation.

In the present embodiment, the developing unit 4D employing magnetic toner and positioned between the non-magnetic developing device 4 and the optical unit 16, suppresses the toner scattering by the magnetic force of the developing roller 8D at the black toner development. Also at the development with the non-magnetic toner, it is prevented from intrusion into the space S1 at the side of the optical unit 16 by the presence of the magnetic developing unit 4D, so that the contamination of the optical unit 16 by the non-magnetic toner can also be prevented. It is therefore rendered possible, by a simple structure without complex mechanism or measure against the toner scattering, to increase the freedom of positioning of the optical unit 16, and thus to provide a compact color image forming apparatus of a high speed.

In the above-explained embodiment, the nonmagnetic developing units **4*a*–4*c* may employ non-magnetic one-component contact development or non-magnetic one-component jumping development, but the non-contact jumping development is preferred in achieving smooth movement of the developing unit thereby suppressing the undesirable influence of the contact on the image. On the other hand, the toner scattering tends to increase in such developing method, because the toner is made to vibrate by the application of the AC bias voltage. The measure against the toner scattering is indispensable particularly in case a centrifugal force is applied to the toner by the rotation of the rotary developing device 4 as in the present embodiment, and the prevention of contamination of the optical unit 16** according to the present invention becomes more effective in such case.

[EMBODIMENT 2]

Figure 2:
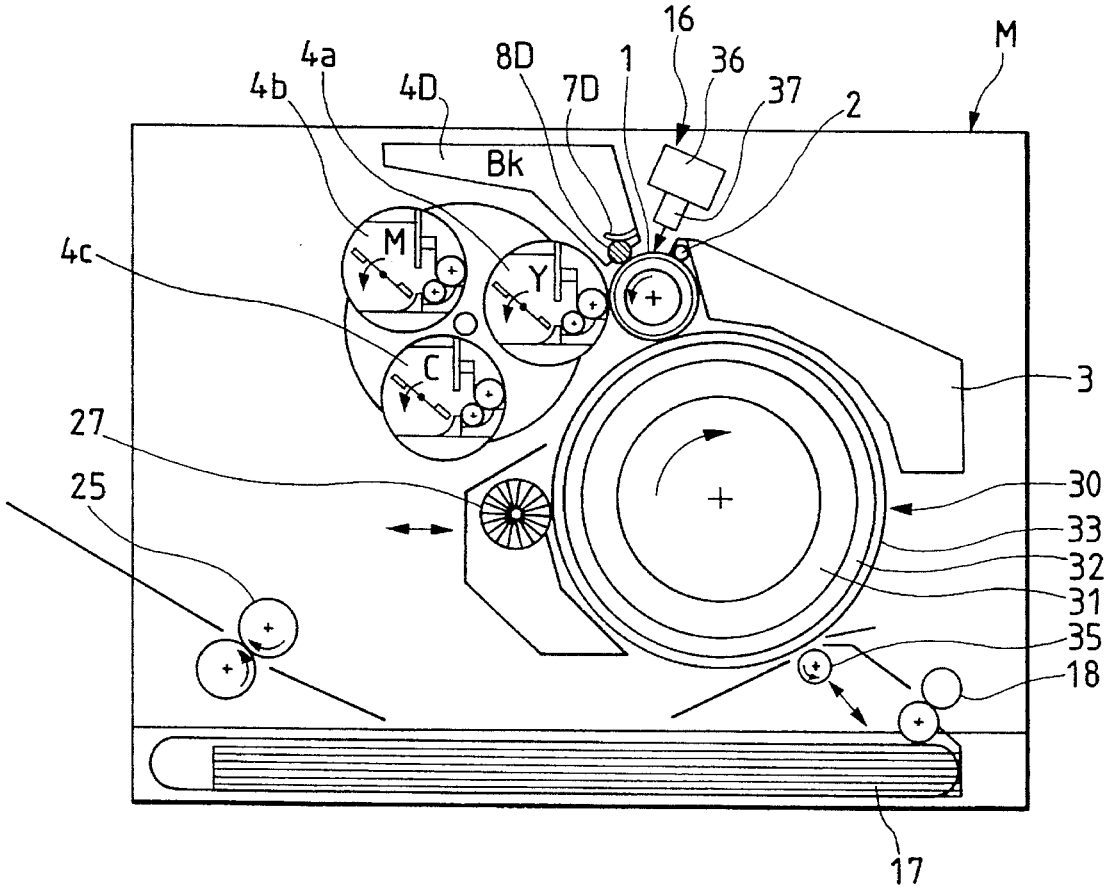
FIG. 2 is a longitudinal cross-sectional view of an image forming apparatus of a second embodiment.

FIG. 2 is a schematic longitudinal cross-sectional view of an image forming apparatus of an embodiment 2, wherein components which are the same as those in FIG. 1 are represented by the same numbers. The present embodiment 2 employs, as the optical unit 16, a solid-state scanner composed of an LED array 36 and a selfoc lens array 37, and is featured by a further compactized dimension achieved through reduced toner scattering to the optical unit 16.

[EMBODIMENT 3]

Figure 3:
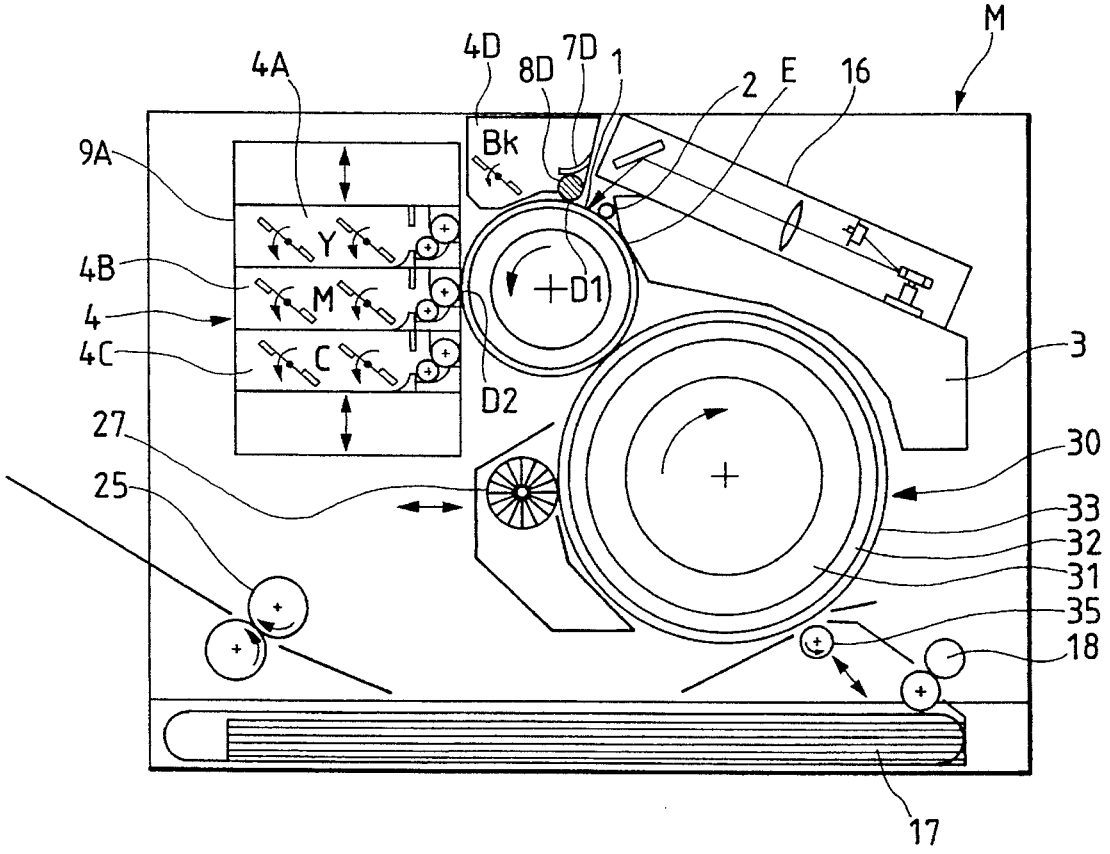
FIG. 3 is a longitudinal cross-sectional view of an image forming apparatus of a third embodiment.

FIG. 3 is a schematic longitudinal cross-sectional view of an image forming apparatus of an embodiment 3, wherein components same as those in FIG. 1 are represented by same numbers. In the present embodiment, plural non-magnetic developing units 4A, 4B and 4C are stacked vertically and are loaded on an elevator member 9A, which is vertically movable and is capable of positioning a developing unit, to be used in the developing operation, at the second developing position D2 opposed to the photosensitive drum 1, by said vertical movement.

This system somewhat increases the dimension of the main body M, but can more easily suppress the toner scattering because the switching of the developing units is achieved by the vertical movement only, in contrast to the rotary developing device 4 of the embodiment 1 in which the toner scattering is facilitated by the centrifugal force applied to the toner. It is also possible to reduce the time required for the switching of the developing units.

[EMBODIMENT 4 ]

Figure 4:
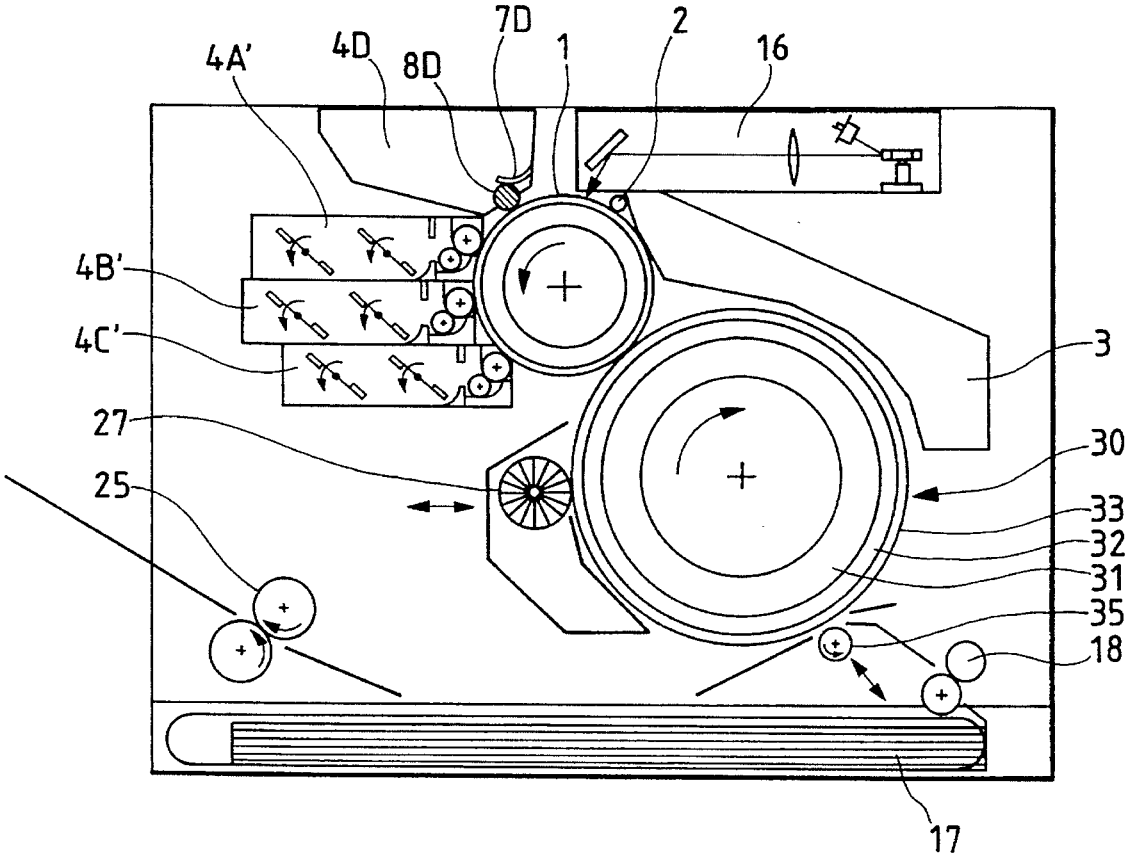
FIG. 4 is a longitudinal cross-sectional view of an image forming apparatus of a fourth embodiment.

FIG. 4 is a schematic longitudinal cross-sectional view of an image forming apparatus of an embodiment 4. In this embodiment, non-magnetic developing units 4A', 4B' and 4C' are individually rendered slidable in the horizontal direction so as to be brought into contact with or separated from the surface of the photosensitive drum 1. Thus, at the development of the latent image on the photosensitive drum 1, a developing unit used in the development is brought into contact with the photosensitive drum 1 while other developing units are separated therefrom.

The present embodiment can further reduce the amount of scattered non-magnetic toner, as the amount of movement of the developing units 4A'—4C' can be decreased.

The foregoing embodiments 1 to 4 employ the drum-shaped intermediate transfer member 30, consisting of an elastic member of a medium conductivity, as the transfer means, because such intermediate transfer method itself is suitable for a high process speed as explained above. Also the medium conductivity dispenses with the charge eliminating step, and the use of the elastic member improves the transferability of the toner image and suppresses the toner fusion and vibrating noises generated between said elastic member and the photosensitive drum 1. Also the drum shape realizes the stability of operation thereby enabling further increase in the process speed.

The present invention exhibits particular effect to the toner scattering which tends to become generally severer in such high-spped apparatus.

The non-magnetic toner employed in the foregoing embodiments can be crushed toner, obtained by mechanical crushing of polymer, or polymerized toner obtained by suspension polymerization of a monomer. The measures of the present invention is particularly effective for the polymerized toner which shows higher fluidity because of almost spherical shape and severer toner scattering in comparison with the crushed toner.

Figure 7:
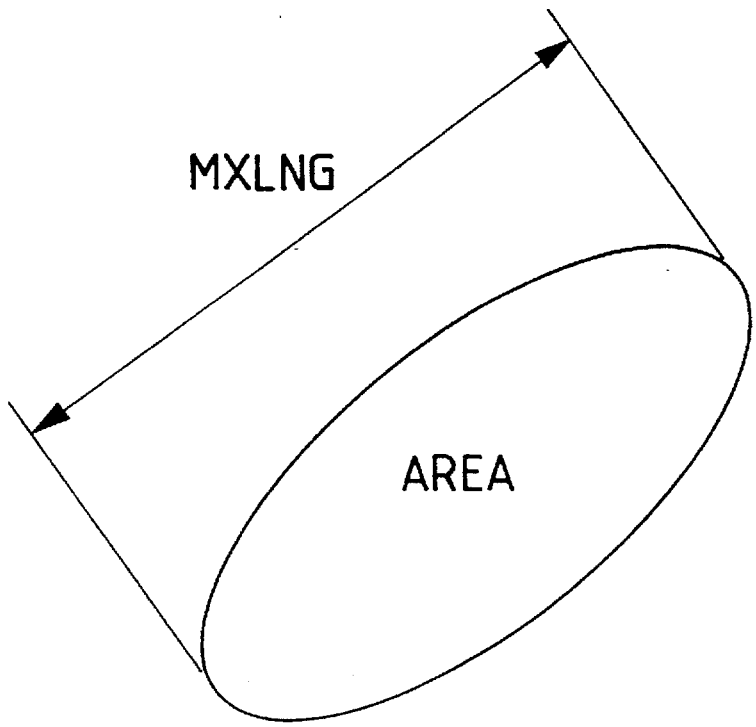
FIG. 7 is a schematic view showing the method of calculation of a shape factor SF1.

In the embodiments of the present invention, the optical unit 16 was free from contamination by the scattered toner, even with polymerized toner containing a low-softening substance in an amount of 5–30 wt. % and having a sphericity represented by the shape factor SF1, indicating the level of circularity of the two-dimensional projection of a spherical substance, within a range of 100–110. Said shape factor SF1 is given by the square of the absolute maximum length MXLNG of a shape obtained by projecting the spherical substance onto a two-dimensional plane as shown in FIG. 7, divided by the area of said projected shape and multiplied by $100\pi/4$.

The above-mentioned low-softening substance is a compound having the main maximum peak within a range from 40° to 90° C. in the measurement according to ASTM D3418-8. In the polymerized toner employed in the foregoing embodiments, the maximum peak temperature is measured, for example, with the Perkin Elmer #DSC-7. The temperature detector is calibrated with the melting point of indium and zinc, and the amount of heat is calibrated by the heat of fusion of indium. The measurement was conducted with a temperature increase rate of 10° C./min., with the sample placed in an aluminum pan while an empty pan is set for reference. More specifically there can be employed paraffin wax, polyolefin wax, Fischer tropisch wax, amide wax, higher fatty acids, ester wax or derivatives thereof or graft/block polymers thereof. There is preferred ester wax represented by a general formula shown in FIG. 8 and having at least a long-chain ester radical containing at least 10 carbon atoms.

Figure 8C:
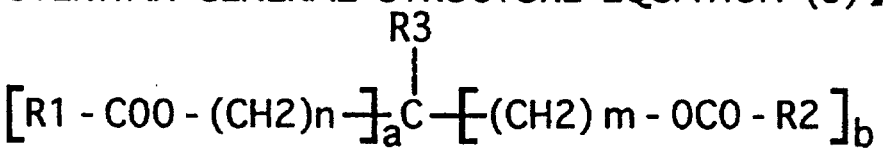
FIG. 8 is a view showing a general structure of ester wax.
Figure 9A:
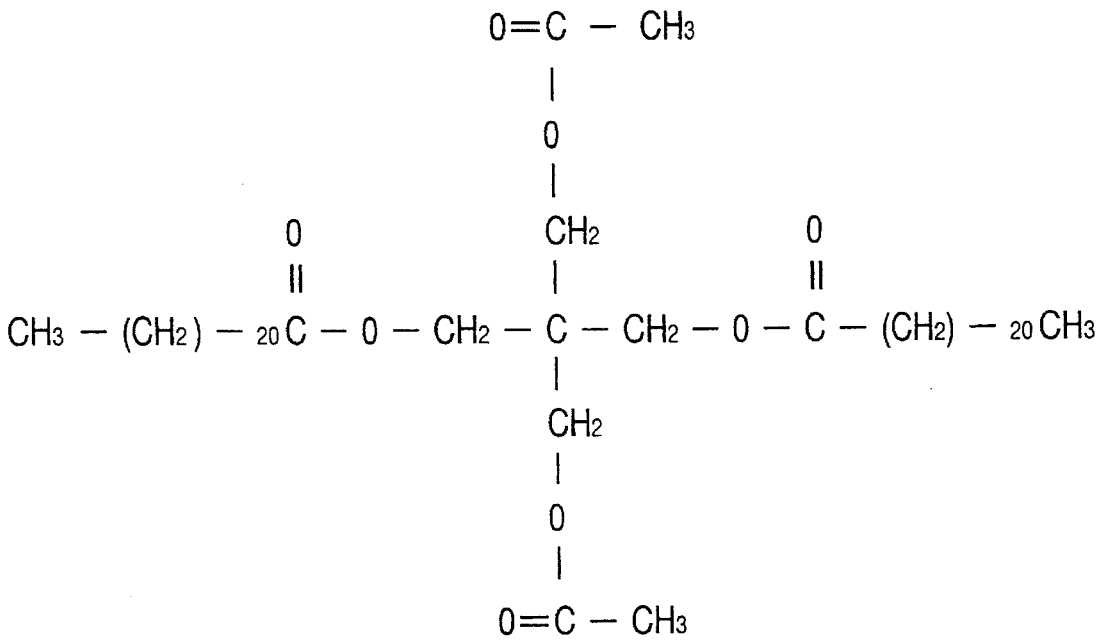
FIGS. 9A, 9B, 10A and 10B are views showing specific chemical structures of ester wax.
Figure 9B:
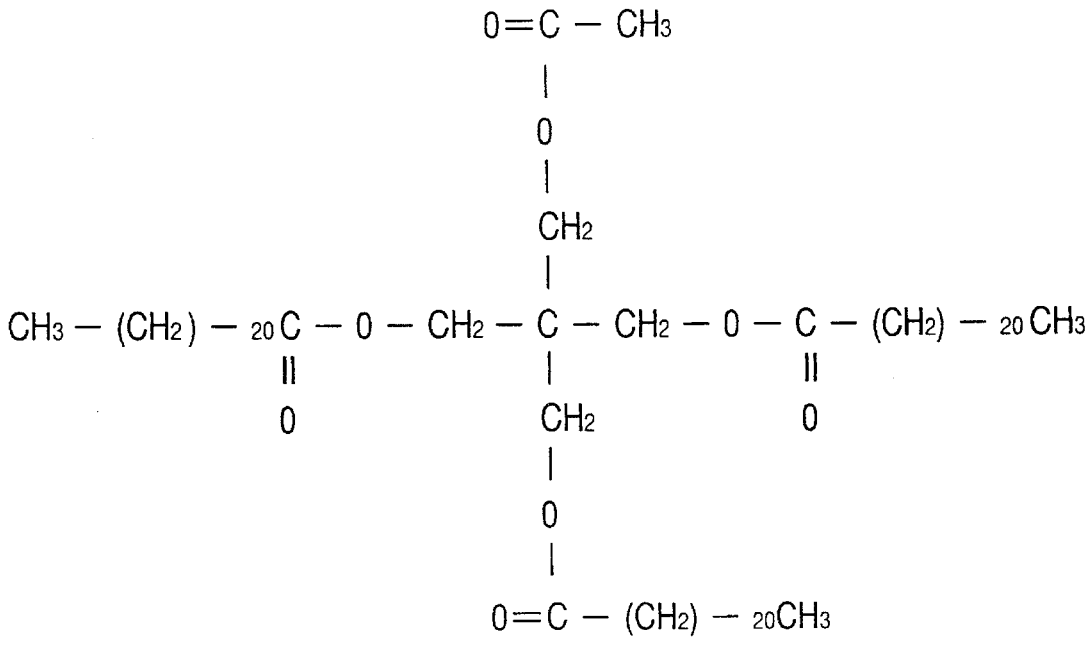
Figure 10A:
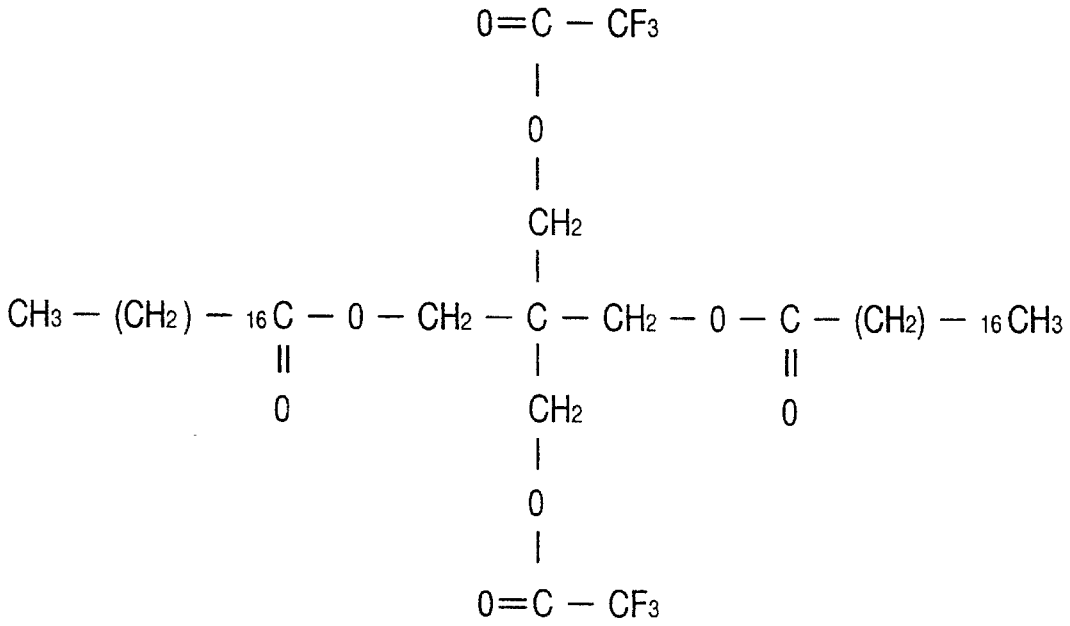
Figure 10B:
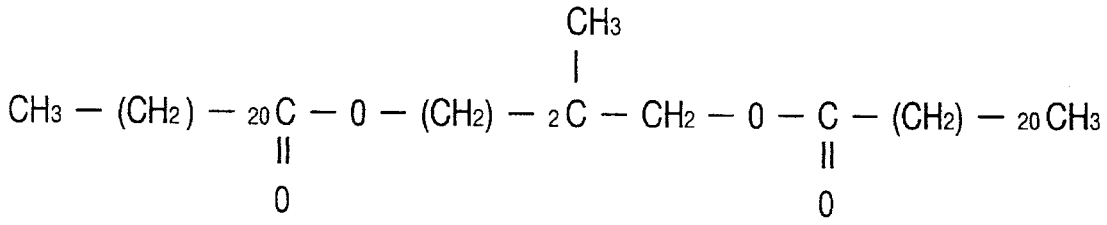

Representative examples of the ester wax employed in the embodiments are shown by general formulas (1), (2) and (3) in FIG. 8.

The ester wax preferred for use in the embodiments has a Vickers' hardness of 0.5–5.0, measured with the Shimadzu dynamic ultramicro hardness meter DUH-200 on a cylindrical sample of a diameter of 20 mmϕ and a thickness of 5 mm. The measurement is conducted under a load of 0.5 g, moved over 10 μm with a load velocity of 9.67 mm/sec and then retained for 15 seconds, and the Vickers' hardness is determined by the measurement of the obtained dent. The ester wax preferred for use in the present invention has a hardness within a range of 0.5 to 5.0. Specific examples of the compound are shown in FIGS. 9A, 9B, 10A and 10B.

Each of the foregoing embodiments employs three non-magnetic developing units, but the present invention is not limited to such embodiments and can achieve similar effect of prevention of intrusion of the scattered toner into the optical unit 16, also when two or only one non-magnetic developing unit is employed. Only one non-magnetic developing unit can be conceived for example in an apparatus for forming an image of two colors of black and red, employing a magnetic developing unit for black color development and a non-magnetic developing unit for red color development.

As explained in the foregoing, the present invention provides, in an image forming apparatus for developing a latent image formed on an image bearing member by latent image forming means, by deposition of magnetic toner and non-magnetic toner respectively by a magnetic developing unit and a non-magnetic developing unit, a simple configuration of positioning the magnetic developing unit between the latent image forming means and the non-magnetic developing unit so as to separate the latter two, thereby enabling to prevent intrusion of the toner, scattered from the non-magnetic developing unit, to the side of the latent image forming means. It is thus rendered possible to effectively prevent defects in image, such as deficient density, resulting from the contamination of the latent image forming means such as the optical unit by the scattered toner.

It is furthermore possible to achieve simplification and compactization of the entire structure and increase in the speed of image forming process, by the absence of necessity for complex mechanism for preventing toner scattering and also by the increased freedom in position of the latent image forming means maintained thus free of the contamination.

The present invention is also effective in a variation in which the aforementioned intermediate transfer member is replaced by the transfer drum shown in FIG. 5, and is furthermore effective in case the transfer means is composed of a transfer roller or a transfer brush so provided in the conventional manner as to press the recording material to the photosensitive member.

Also the image bearing member or the transfer means need not be formed as a drum but can also be formed as a belt.

What is claimed is:

1. An image forming apparatus for forming a color image with dry developer, comprising:

an image bearing member effecting endless movement;

charging means for charging said image bearing member to a predetermined potential;

optical means for exposing said image bearing member to image information;

first developing means utilizing developer containing a magnetic component, and comprising a single developing device which is opposed to said image bearing member in a fixed position, said charging means, optical means and first developing means being arranged in this order along the moving direction of said image bearing member;

second developing means positioned at the downstream side of said first developing means and utilizing non-magnetic developer of a color different from that of the developer of said first developing means, said second developing means comprising a plurality of developing devices operating independently of said first developing means, and one of the developing devices of said second developing means, when rotated, being opposed to said image bearing member; and transfer means maintained in contact with or close to said image bearing member for transferring an image of the developer formed on said image bearing member by said first and second developing means, wherein a space containing said second developing means is enclosed by the shape of said first developing means, transfer means and image bearing member.

2. An image forming apparatus according to claim 1, wherein said first developing means is for development of black color, and said second developing means is for development of another color.

3. An image forming apparatus according to claim 2, wherein said first developing means employs one-component magnetic developer.

4. An image forming apparatus according to claim 2, wherein said first developing means employs two-component magnetic developer consisting of magnetic carrier and non-magnetic toner.

5. An image forming apparatus for forming a color image with dry developer, comprising:

an image bearing member effecting endless movement;

charging means for charging said image bearing member to a predetermined potential;

optical means for exposing said image bearing member to image information;

first developing means utilizing developer containing a magnetic component, and comprising a single developing device which is opposed to said image bearing member in a fixed position, said charging means, optical means and first developing means being arranged in this order along the moving direction of said image bearing member;

second developing means positioned at the downstream side of said first developing means and utilizing non-magnetic developer of a color different from that of the developer of said first developing means, said second developing means comprising a plurality of developing devices operating independently of said first developing means, and one of the developing devices of said second developing means, when rotated, being opposed to said image bearing member; and transfer means for pressing a recording material to an image bearing member in order to transfer an image of the developer, formed on said image bearing member by said first and second developing means, onto said supplied recording material;

wherein a space containing said second developing means is enclosed by the shape of said first developing means, transfer means and image bearing member.

6. An image forming apparatus according to claim 5, wherein said first developing means is for development of black color, and said second developing means is for development of another color.

7. An image forming apparatus according to claim 5, wherein said optical means is positioned higher than said second developing means with respect to said image bearing member.

8. An image forming apparatus for forming a color image with dry developer, comprising:

an image bearing member effecting endless movement;

charging means for charging said image bearing member to a predetermined potential;

optical means for exposing said image bearing member to image information;

first developing means for black color, utilizing developer containing a magnetic component, and comprising a single developing device which is opposed to said image bearing member in a fixed position, said charging means, optical means and first developing means being arranged in this order along the moving direction of said image bearing member;

second developing means positioned at the downstream side of said first developing means and containing plural developing units utilizing non-magnetic color developers of colors different from that of said first developing means, said second developing means comprising a plurality of developing devices operating independently of said first developing means, and one of the developing devices of said second developing means, when rotated, being opposed to said image bearing member; and transfer means for transferring images of developers, formed in succession on said image bearing member by said first and second developing means, in succession onto a recording material supplied onto and maintained on said transfer means;

wherein a space containing said second developing means is enclosed by the shape of said first developing means, transfer means and image bearing member.

9. An image forming apparatus according to claim 8, wherein said optical means is provided higher than said second developing means with respect to said image bearing member.

10. An image forming apparatus for forming a color image with dry developer, comprising:

an image bearing member effecting endless movement;

charging means for charging said image bearing member to image information;

optical means for exposing said image bearing member to image information;

first developing means for black color, utilizing developer containing a magnetic component, and comprising a single developing device which is opposed to said image bearing member in a fixed position, said charging means, optical means and first developing means being arranged in this order along the moving direction of said image bearing member;

second developing means positioned at the downstream side of said first developing means and containing plural developing units utilizing non-magnetic color developers of colors different from that of said first developing means, said second developing means comprising a plurality of developing devices operating independently of said first developing means, and one of the developing devices of said second developing means, when rotated, being opposed to said image bearing member; and transfer means for transferring images of developers, formed on said image bearing member by said first and second developing means, collectively onto a recording material;

wherein a space containing said second developing means is enclosed by the shape of said first developing means, transfer means and image bearing member.

11. An image forming apparatus according to claim 10, wherein said optical means is positioned higher than said second developing means with respect to said image bearing member.

12. An image forming apparatus for forming a color image with dry developer, comprising:

an image bearing member effecting endless movement;

charging means for charging said image bearing member to a predetermined potential;

optical means for exposing said image bearing member to image information;

first developing means for black color, utilizing developer containing a magnetic component, and comprising a single developing device which is opposed to said image bearing member in a fixed position, said charging means, optical means and first developing means being arranged in this order along the moving direction of said image bearing member;

second developing means positioned at the downstream side of said first developing means and containing plural developing units utilizing non-magnetic color developers of colors different from that of first developing means, said second developing means comprising a plurality of developing devices operating independently of said first developing means, and one of the developing devices of said second developing means, when rotated, being opposed to said image bearing member; and transfer means for transferring images of developers, formed in succession on said image bearing member by said first and second developing means, in succession onto said transfer means;

wherein a space containing said second developing means is enclosed by the shape of said first developing means, transfer means and image bearing member.

13. An image forming apparatus according to claim 12, wherein said optical means is positioned higher than said second developing means with respect to said image bearing member.

* * * * *

UNITED STATES PATENT AND TRADEMARK OFFICE

CERTIFICATE OF CORRECTION

PATENT NO. : 5,600,431

DATED : February 4, 1997

INVENTORS : Masami Takeda, et al.

It is certified that error appears in the above-identified patent and that said Letters Patent is hereby corrected as shown below:

COLUMN 2

Line 3, "Applications" should read --application--; and
Line 32, "polygon" should read --polygonal--.

COLUMN 5

Line 36, "through" should read --by--

COLUMN 6

Line 61, "compactization" should read --compaction--.

COLUMN 7

Line 20, "in case" should read --in a case where--;
Line 24, "such" should read --such a--;
Line 32, "selfoc" should read --Selfoc--;
Line 33, "compactized" should read --compacted--; and
Line 38, "components" should read --components the-- and "by" should read --on--.

COLUMN 8

Line 12, "to" should read --on--;
Line 14, "high-spped" should read --high-speed--;
Line 19, "is" should read --are--;
Line 41, "with" should read --by--; and
Line 46, "is" should read --was--;

UNITED STATES PATENT AND TRADEMARK OFFICE

CERTIFICATE OF CORRECTION

PATENT NO. : 5,600,431

DATED : February 4, 1997

INVENTORS : Masami Takeda, et al.

It is certified that error appears in the above-identified patent and that said Letters Patent is hereby corrected as shown below:

COLUMN 9

Line 5, "two or only one" should read --only one or two--;
Line 6, "unit is" should read --units are--;
Line 20, "enabling to prevent" should read --preventing--;
Line 27, "compactization" should read --compaction--;
Line 28, "of" should read --of the--; and
Line 35, "in case" should read --in a case where--.

COLUMN 11

Line 25, "provided" should read --positioned--; and
Line 33, "image information;" should read --a predetermined potential;--

Signed and Sealed this

Twelfth Day of August, 1997

Bruce Lehman

*Attest:*

BRUCE LEHMAN

*Attesting Officer*

*Commissioner of Patents and Trademarks*